United States Patent [19]

Thievessen

[11] Patent Number: 4,730,779

[45] Date of Patent: Mar. 15, 1988

[54] EXPANDING MANDREL ASSEMBLY FOR A WEB-COILING CORE

[75] Inventor: Karl Thievessen, Grevenbroich, Fed. Rep. of Germany

[73] Assignee: Jagenberg Aktiengesellschaft, Dusseldorf, Fed. Rep. of Germany

[21] Appl. No.: 874,283

[22] Filed: Jun. 13, 1986

[30] Foreign Application Priority Data

Jun. 15, 1985 [DE] Fed. Rep. of Germany ..... 3521582
Jun. 15, 1985 [DE] Fed. Rep. of Germany ... 8517584[U]

[51] Int. Cl.[4] ..... B65H 16/04; B65H 18/04; B65H 67/00

[52] U.S. Cl. ..... 242/72 R; 279/2 R

[58] Field of Search ..... 242/56.9, 68.2, 72 R, 242/46.4, 68.3, 46.3; 279/2 R; 269/48.1

[56] References Cited

U.S. PATENT DOCUMENTS 3,910,520 10/1975 Mosser ..... 279/2 R X
4,334,652 6/1982 Blackburn ..... 279/2 R X
4,339,094 7/1982 Thievessen et al. ..... 242/72 R X
4,635,872 1/1987 Thievessen ..... 242/72 R

FOREIGN PATENT DOCUMENTS 2612375 10/1977 Fed. Rep. of Germany .... 242/72 R
2910114 9/1980 Fed. Rep. of Germany .... 242/72 R
3329330 2/1985 Fed. Rep. of Germany .

*Primary Examiner*—David Werner
*Attorney, Agent, or Firm*—Karl F. Ross; Herbert Dubno

[57] ABSTRACT

An expanding mandrel for clamping a tubular member, especially a tubular core on which a paper web can be coiled in a machine for coiling the web or for supplying the web from a coil, has a pin with flat surfaces against which bracing elements support angularly equispaced segments in a cage which are pressed outwardly to urge convex surfaces of the segments against the inner surface of the core. Along longitudinal edges of the segments rounded rises or protuberances are provided which prevent stress peaks tending to damage the core.

20 Claims, 4 Drawing Figures

EXPANDING MANDREL ASSEMBLY FOR A WEB-COILING CORE

CROSS REFERENCE TO RELATED APPLICATION

This application is related to copending application Ser. No. 638,818 filed Aug. 8, 1984, now U.S. Pat. No. 4,635,872.

FIELD OF THE INVENTION

My present invention relates to an expanding mandrel assembly for tubular members or sleeves, especially cardboard sleeves adapted to constitute cores for the coiling of material in the form of a web, especially a paper web.

BACKGROUND OF THE INVENTION

In the handling of web materials, it is common to provide a tubular element or sleeve to constitute a core of the machine which winds or unwinds a coil of the web material.

The web material, e.g. a paper web derived from a paper-making machine, can have its free end adhered to the core by an adhesive or glue.

The core can be engaged, in such machines, on an expanding mandrel which can comprise a pin about which two segmental gripping elements are disposed for radial displacement in a cage, bracing elements being provided between each gripping element and the pin.

The outer surfaces of the segments, therefore, engage the inner surface of the tubular member or core, while inner surfaces of these segments are urged outwardly by the bracing elements.

The pin and the bracing elements are so arranged vis-a-vis one another so that a relative displacement of the segments and the pin can transform a torque into a radial displacement of the segments to press them against the inner wall or surface of the core and retain the core on the thus expanded mandrel. Reverse rotation of the pin enables retraction of the segments and release of the core.

In the past, the outer surfaces of the gripper segments were either largely smooth or provided with a zigzag serrated configuration with sharp crests. A smooth surface has the advantage that the cardboard core is not damaged at the inner surface regions engaged by the segments of the expanding mandrel and are not abraded. However, there is of course the disadvantage that the torque transfer from the mandrel to the core is limited and less reliable.

Toothed or serrated segments as are described in German patent document DE-OS No. 33 29 330 (see U.S. Pat. No. 4,635,872) have, of course, the advantage that the crests of the serrations can bite into the relatively softer inner surface of the cardboard core and, in a form-locking manner insure positive torque transfer or development of the necessary moments.

This system, while generally highly effective, has been found to have the disadvantage that the braking moments applied to the sleeve or core can result in a significant abrasion or tearing of the inner surface of the core into which the teeth bite.

The distortion of the surface of the core where it engages the teeth and the nature of the toothed engagement of the segments in the cardboard of the core can be so extreme that release of the core after the coil has been unrolled from it is difficult.

The abrasion of the inner surface of the core with pointed or edged teeth can also cause significant local stresses in the core to the point that the core structure itself is damaged, especially with torque overloads as may occur from time to time in the unrolling operation.

Because the local stresses are so significant, the intermittent application of substantial torques and their sudden terminations can contribute to deterioration, not only of the inner surface of the core, but also of the basic core structure as a whole.

In earlier devices, it has been the practice to provide the rotary pin as a collateral polygon in cross section, having grooves in which the bracing elements, which can have a complementary cross section to the groove, can engage. The bracing elements can also have ball-shaped or flat contact surfaces in engagement with the segments.

These systems are complex and time consuming to fabricate, and, of course, are comparatively inexpensive. This is especially the case because of the need of the aforementioned grooves in earlier expanding mandrel systems and the requirement that the bracing elements have convex contours conforming to the contours of the groove.

OBJECTS OF THE INVENTION

It is the principal object of the present invention to provide an expanding mandrel apparatus which overcomes the above-mentioned drawbacks and, especially for the cores of paper-web coils or rolls, allows an effective torque transfer between the mandrel and the core, without local stresses which tend to tear the cardboard inner surface of the core.

Another object of this invention is to provide an expanding mandrel assembly for the cores of web rolls or coils which is of low-cost construction, ensures a firm grip on the core, will permit the core to be radially removed when the coil is unrolled, and which is less susceptible to wear and is more reliable than earlier expanding mandrel constructions.

Yet another object of my invention is to provide an expanding mandrel arrangement of simple and inexpensive construction with high stability and reduced tendency to wear so that the operating life of the assembly is comparatively long.

SUMMARY OF THE INVENTION

These objects and others which will become apparent hereinafter are attained, in accordance with the present invention, in an expanding mandrel of the above-described type, i.e. having a horizontal pin journaled for rotation about a horizontal axis, a plurality of angularly equispaced tubular segmental radially displaceable clamping elements surrounding the pin and mounted thereon via a cage surrounding the pin and maintaining these elements in spaced relation therearound and respective bracing members between the pin and each element for urging the elements radially outwardly into engagement with the inner surface of a tubular member or sleeve which can constitute a core for a web coil or roll, especially a coil of paper.

According to the invention, these segmental elements each have an outer curvilinearly convex surface engageable with the inner surface of the core and provided with relatively widely spaced domed rises.

The domed rises have been found to provide effective torque transfer between the mandrel and a cardboard core with sharply reduced peak stresses so that the forces which develop between the segments and the cardboard sleeve are dispersed over a comparatively large area around these rises.

Since the distance between the rises and each segment are comparatively large, approximating the circumferential extent of the segments, there is little tendency for stresses generated by one of the rises from being superimposed upon stresses generated by another rise, thereby further diminishing any tendency toward damage of the core.

It has been found to be advantageous to provide the rises with crests which lie along an imaginary cylinder whose diameter is slightly greater than the inner diameter of the tubular core. Preferably, the rises are formed as axially extending ribs which are disposed proximal to the opposite longitudinal sides of the segments and the crests of these ribs can be spaced from the axis of the expandable mandrel by a radial distance which is only slightly greater than the inner diameter of the core to be engaged.

In this case, the rises do indeed penetrate into the cardboard of the core, but without significant destruction thereof and effective torque transfer between the core and the mandrel is ensured, i.e. there is little or no relative movement between the segments and the core.

In spite of this form-locking relationship, therefore, the distribution of stress is so great along each rib that tearing of the mandrel is precluded.

Tests in practice have shown that even with the greater radius of the crests of the rises, the core can be readily slipped over the mandrel or the mandrel into the core with penetration of the rises readily into the core material upon expansion of the mandrel such that relative rotation of the expanded mandrel and the core is precluded. Abrasion and tearing of the core is excluded as noted and the interfitting engagement of the mandrel and the core is not of such intensity that one has difficulty in withdrawing the core from the mandrel.

According to a feature of the invention, the rises have centers (or axes) of curvature which lie along radii from the axis of the mandrel spaced from an axial median plane through the respective segment or segmental element by an angle of substantially 20° to 30° and preferably 25°. It is also advantageous to provide radiuses or fillets at which the ribs merge with the respective curvilinearly convex surfaces, these fillets having radii of curvature which are substantially twice the radius of the crest of the respective rib.

Advantageously, the pin is polygonal in cross section and is preferably square and the contact surfaces of the bracing elements, which are disposed in pairs at diametrically opposite sides of the pin, can be flat surfaces engageable with the flat surfaces of the pin. With the square cross section, the flat surfaces of the pin are disposed in parallel pairs. Surprisingly, this construction can eliminate the need for grooves in the pin cross section. This not only sharply reduces the fabrication cost of an expanding mandrel according to the invention and simplifies the structure, but the flat contact between the pin and bracing element, ensures a proper engagement of each bracing element with the pin in all angular positions. The pin may be provided with bevels between the aforementioned surfaces and in the construction of the invention, even with large relative angular displacements of the pin and the cage, and will not jam, even when the mandrel is released from the core.

Advantageously, the bracing elements are cap-shaped in cross section at their ends engageable with the gripper segments and these force-transmitting elements thus have the advantage that while their flat ends can remain braced against the flat surfaces of the pin, their cap-shaped ends permit limited wobbling of the segments as they engage the core. Optimum force distribution between the pin and the segments is thus ensured since the engagement of the rounded heads of the bracing elements and the spherical sockets or recesses of the gripper segments in which they engage allow a swivel-type of action. This provides a further protection against jamming.

To allow a maximum force development, the surfaces of the pin which engage the bracing element can be polished and nitrided.

The bevels of the pin can, moreover, be rounded and the pin can be formed between a flange and an annular portion of the cage with an axial or thrust bearing to permit extremely high loads to be tolerated.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
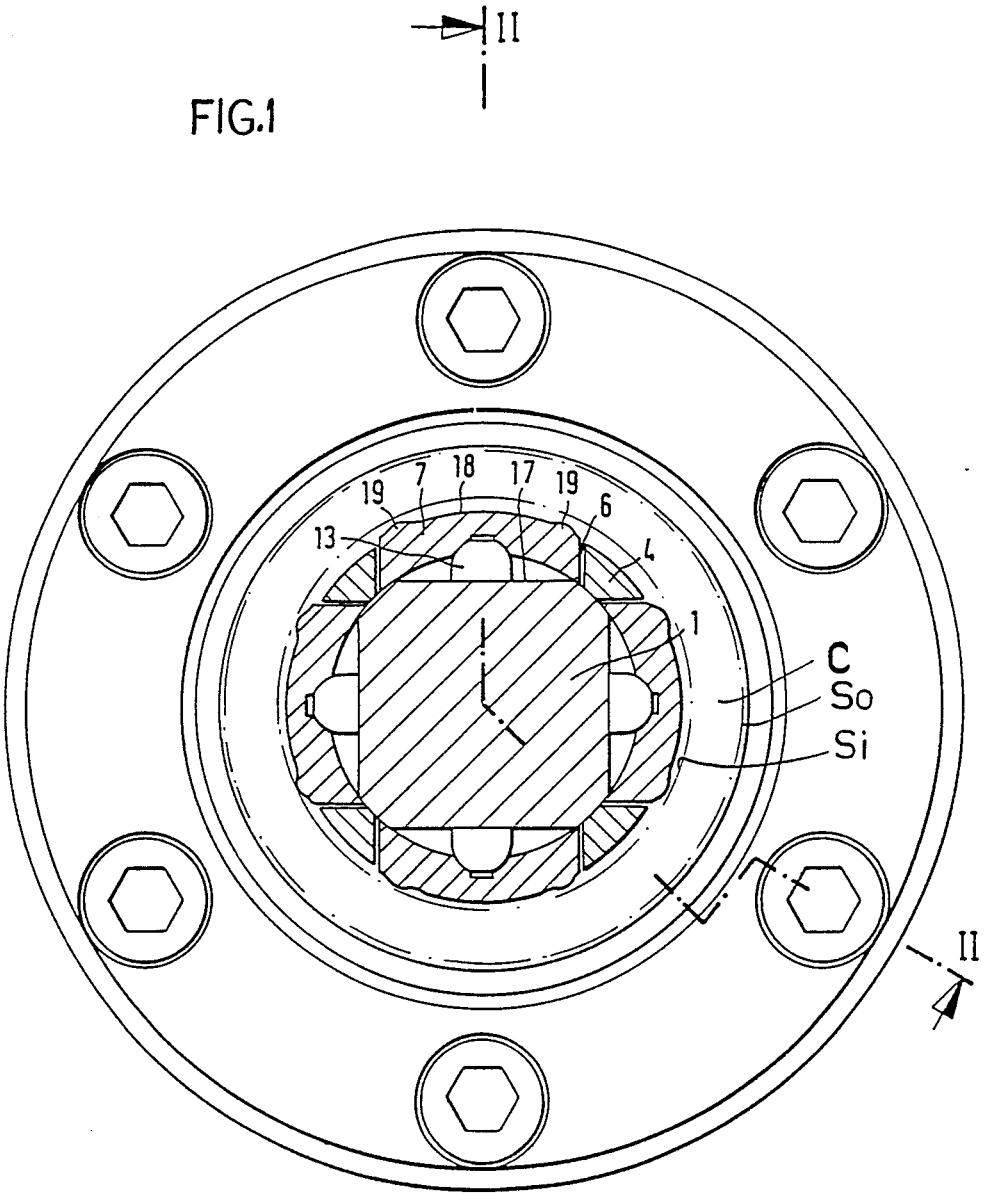
FIG. 1 is an end view of an expanding mandrel according to the invention having the pin, cage and gripping segment assembly in a transverse section along the line I—I of FIG. 2.

The expanding mandrel arrangement shown in the drawing is intended to engage a cardboard sleeve C, whose inner surfaces $s_i$ and outer surface $s_o$ are represented in dot-dash lines in FIG. 1. The expanding mandrel comprises a pin which is shown to be formed with a flange construction, the flange 2 of the pin being connected by the bolts 3 to the apparatus which supports the mandrel and which allows a coil of web material to be unrolled or a coil to be formed by driving the core. The structure to which the expanding mandrel can be affixed can, of course, correspond to that to which the expanding mandrel of the German patent document DE-PS No. 33 29 330 is affixed.

Between the annular portion of the cage 4 surrounding the pin 1 and the flange 2 is an axial or thrust bearing 5 which can take up the axial forces which are developed.

As can be seen especially from FIG. 1, the cage 4 has four equispaced window-like openings 6 in which tubular segmental clamping or gripping elements 7 are received.

The segmental elements or segments 7 are retained in the cage 4 by annular coil springs 8 and 9 which are under pretension. The cage is fastened by a guide disk 11 and a fastening screw 12 at the end of the pin 1 opposite its flange.

Between the segments 7 and the pin 1, bracing elements 13 are provided. Each of these bracing elements 13 is a stud having an outer end which is hemispherical or cap-shaped and is received in a hemispherical socket or recess 15 formed in the inner surface 14 of the respective segment 7. In the embodiment illustrated, the segments 7 are axially elongated and two such studs are provided along the longitudinal median plane 21 of the segment (see FIG. 4).

At their opposite ends, each of these studs has a flat contact surface 16 which bears upon the flat surface 17 of the pin. The flat surfaces 17 are provided in two pairs of parallel surfaces, each of which is associated with a respective segment 7 and pairs of studs 13.

Upon application of a torque to the pin 1 tending to rotate it relative to the cage 4 and the segments 7, the bracing elements 13 are cammed radially outwardly to urge the segments 7 outwardly against the inner surface $s_i$ of the core C.

The bracing elements 13 have substantially cap-shaped or hemispherical ends which engage in corresponding hemispherical sockets of the respective elements 7 and, at their opposite ends, are planar to ride on the flat surfaces of the pin 1.

This combination of flat contact between the bracing element and the pin and a ball joint between the bracing element and the clamping segment 7 formed by the hemispherical recess 15 allows the segments 7 to tilt or cant to a given degree about the axis of the pin 1 when the latter is rotated relative to the cage to press the segments against the inner wall of the tubular core.

Figure 2:
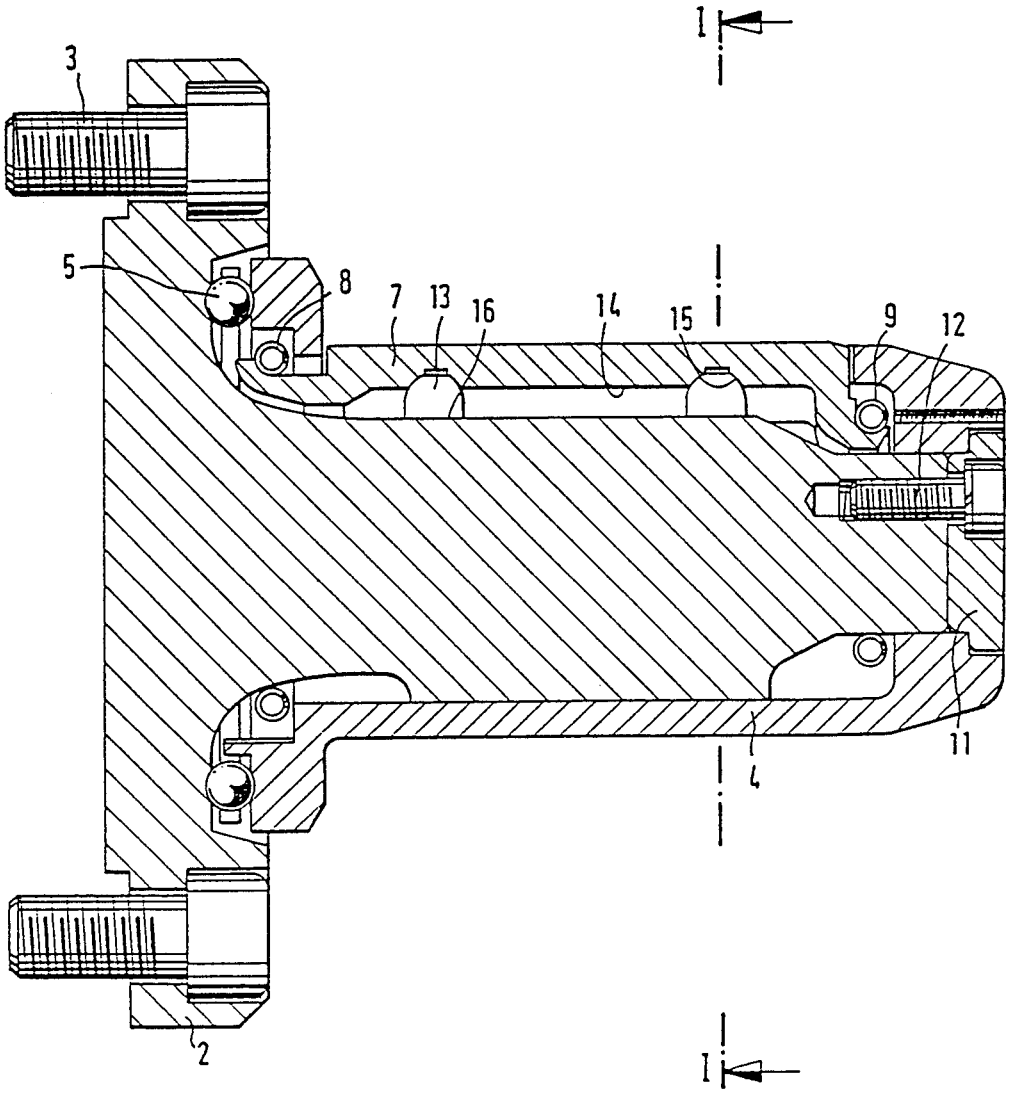
FIG. 2 is a section taken along the line II—II of FIG. 1.
Figure 3:
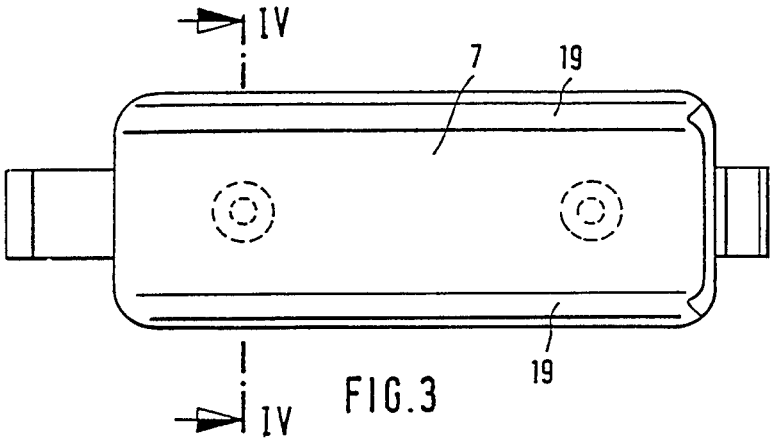
FIG. 3 is an elevational view of one of the gripper elements or segments of the assembly.

For precise gripping of the core without stress peaks, we have found that it is essential to provide the generally curvilinearly convex outer surface 18 of each of the clamping elements or segments 7 in the region of the outer edges thereof, constituting longitudinal edges when the segments are axially elongated, as shown (compare FIG. 2) with domed protuberances or rises 19.

These rib or skid-like rises 19 are thus located along opposite longitudinal edges and have a diameter at their crests as measured across an imaginary cylinder circumscribed about these crests which is slightly greater than the inner diameter of the coiling core to be engaged by the expanding mandrel.

In this manner, even before the segments 7 are pressed outwardly and as the core is thrust onto the expanding mandrel, the rises 19 will press into the inner surface of the coiling sleeve to thereby create a form-locked connection between each segment 7 and the core.

Figure 4:
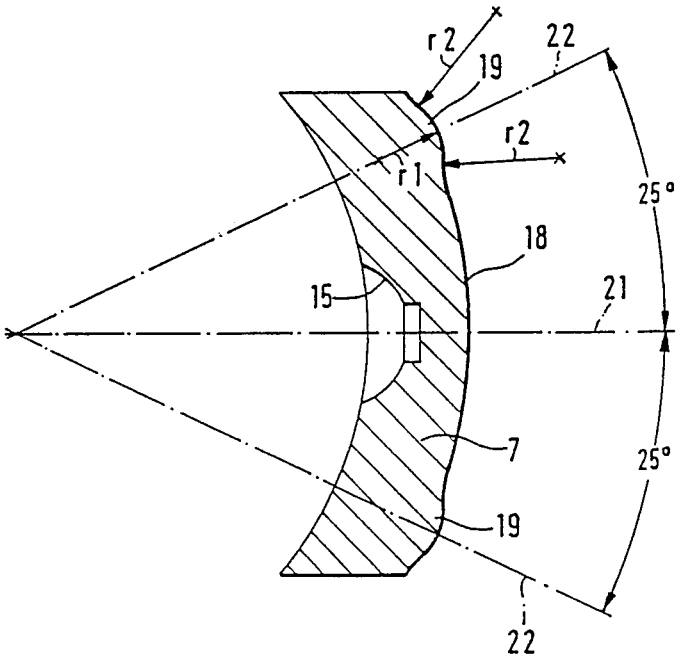
FIG. 4 is a section taken along the line IV—IV of FIG. 3 drawn to a larger scale.

Advantageously the radius of curvature R1 of each of the rises 19 can have its center of curvature lying along a radius which includes an angle of about 25° with the longitudinal median plane of the segment as has been illustrated in FIG. 4. Furthermore, the rounded crests of each rise 19 can be connected by a fillet with a radius R2 which can be about twice the radius R1 with the balance of the curved outer surface 18 of the segment.

The rises or ribs 19 can extend uninterruptedly over the entire length of the segment as has been shown, or alternatively, the rises can be subdivided into discrete dome-shaped protuberances which can be equispaced along each longitudinal edge, of the clamping segment 7.

In addition to allowing insertion of the expanding mandrel into a core of hard material or thrusting of the core onto the expanding mandrel, the height of the rises can increase from the free end of the expanding mandrel toward its separated end with a slight inclination or pitch.

Assembly of the expanding mandrel is simple in that the segments 7, after the bracing elements 13 have been inserted into the recesses 15, can be placed upon the pin 1 and fixed in place by the annular springs 8 and 9. The cage 4 is then thrust axially over the pin and is fastened in place by the set screw 12 and the washer or disk.

I claim:

1. In an expanding mandrel apparatus for clamping a tubular member, especially a tubular core on which a paper web is adapted to be coiled, comprising a horizontal pin journaled for rotation about a horizontal axis, a plurality of angularly equispaced tubular segmental radially displaceable clamping elements surrounding said pin and mounted thereon, a cage surrounding said pin and maintianing said elements in position therearound, a cage surrounding said pin and maintaining said elements in position therearound, and respective bracing members between said pin and each of said elements for urging said elements radially outwardly into engagement with an inner surface of said tubular core, the improvement wherein:

said elements have outer curvilinearly convex surfaces generally with a curvature corresponding to that of said inner surface, engageable with said inner surface and provided with widely spaced domed rises separated by a broad continuous convex surface.

2. The improvement defined in claim 1 wherein said rises have crests which lie along an imaginary cylinder whose diameter is slightly greater than the inner diameter of said tubular core.

3. The improvement defined in claim 2 wherein said rises are formed as axially extending ribs adjacent opposite longitudinal sides of said elements.

4. The improvement defined in claim 3 wherein said ribs are flanked by fillets at which said ribs merge with the respective curvilinearly convex surfaces.

5. The improvement defined in claim 4 wherein said fillets have radii which are substantially twice the radius of the crest of the respective rib.

6. The improvement defined in claim 3 wherein said crests, have in a longitudinal direction a slight inclination with respect to said axis.

7. The improvement defined in claim 2 wherein said pin has a polygonal cross section and said bracing members bear against surfaces of said pin provided in mutually parallel pairs.

8. The improvement defined in claim 7 wherein said pin has a square cross section.

9. The improvement defined in claim 7 wherein said bracing members are generally cap-shaped in cross section.

10. The improvement defined in claim 7 wherein said surfaces of said pin are polished and nitrided.

11. The improvement defined in claim 7 wherein said pin is rounded between said surfaces thereof.

12. The improvement defined in claim 7 wherein said pin has between an annular flange extending outwardly from a shank of the pin provided with said surfaces of said pin, and an annular surface of said cage, an axial thrust bearing.

13. In an expanding mandrel apparatus for clamping a tubular member, especially a tubular core on which a paper web is adapted to be coiled, comprising a horizontal pin journaled for rotation about a horizontal axis, a plurality of angularly equispaced tubular segmental radially displaceable clamping elements surrounding said pin and mounted thereon, a cage surrounding said pin and maintaining said elements in position therearound, and respective bracing members between said pin and each of said elements for urging said elements radially outwardly into engagement with an inner surface of said tubular core, the improvement wherein:

said elements have outer curvilinearly convex surfaces engageable with said inner surface and provided with widely spaced domed rises, and said rises have centers of curvature for each element which lie along radii from said axis which are spaced from an axial medial plane through the respective element by an angle of substantially 20° to 30°.

14. The improvement defined in claim 13 wherein said angle for the center of curvature of each of said rises is 25°.

15. An expanding mandrel apparatus for clamping a tubular member, especially a tubular core on which a paper web is adapted to be coiled, comprising:

a horizontal pin of generally prismatic cross section formed with pair of opposite flat surfaces and journaled for rotation about a horizontal axis;

a plurality of angularly equispaced tubular segmental radially displaceable clamping elements surrounding said pin and mounted thereon;

a cage surrounding said pin and maintaining said elements in position therearound; and respective bracing members between said surfaces of said pin and each of said elements for urging said elements radially outwardly into engagement with an inner surface of said tubular core, said elements having outer curvilinearly convex surfaces generally with a curvature corresponding to that of said inner surface, engageable with said inner surface and provided with widely spaced domed rises, separated by a broad continuous convex surface.

16. The apparatus defined in claim 15 wherein said rises have crests which lie along an imaginary cylinder whose diameter is slightly greater than the inner diameter of said tubular core.

17. The apparatus defined in claim 16 wherein said rises are formed as axially extending ribs adjacent opposite longitudinal sides of said elements.

18. An expanding mandrel apparatus for clamping a tubular member, especially a tubular core on which a paper web is adapted to be coiled, comprising:

a horizontal pin of generally prismatic cross section formed with pair of opposite flat surfaces and journaled for rotation about a horizontal axis;

a plurality of angularly equispaced tubular segmental radially displaceable clamping elements surrounding said pin and mounted thereon;

a cage surrounding said pin and maintaining said elements in position therearound; and respective bracing members between said surfaces of said pin and each of said elements for urging said elements radially outwardly into engagement with an inner surface of said tubular core, said elements having outer curvilinearly convex surfaces engageable with said inner surface and provided with widely spaced domed rises, said rises having crests which lie along an imaginary cylinder whose diameter is slightly greater than the inner diameter of said tubular core, said rises being formed as axially extending ribs adjacent opposite longitudinal sides of said elements, said rises having centers of curvature for each element which lie along radii from said axis which are spaced from an axial median plane through the respective element by an angle of substantially 20° to 30°.

19. The improvement defined in claim 18 wherein said ribs are flanked by fillets at which said ribs merge with the respective curvilinearly convex surfaces.

20. The apparatus defined in claim 19 wherein said fillets have radii which are substantially twice the radius of the crest of the respective rib.

* * * * *